US006922667B2

(12) United States Patent
Tsushima et al.

(10) Patent No.: US 6,922,667 B2
(45) Date of Patent: Jul. 26, 2005

(54) ENCODING APPARATUS AND DECODING APPARATUS

(75) Inventors: Mineo Tsushima, Osaka (JP); Takeshi Norimatsu, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 744 days.

(21) Appl. No.: 10/061,977

(22) Filed: Jan. 31, 2002

(65) Prior Publication Data

US 2002/0152085 A1 Oct. 17, 2002

(30) Foreign Application Priority Data

Mar. 2, 2001 (JP) ..... 2001-057746

(51) Int. Cl.[7] ..... G10L 19/02
(52) U.S. Cl. ..... 704/219; 704/222
(58) Field of Search ..... 704/219–222

(56) References Cited

U.S. PATENT DOCUMENTS 5,826,226 A * 10/1998 Ozawa ..... 704/223
6,496,796 B1 * 12/2002 Tasaki et al. ..... 704/219
6,856,955 B1 * 2/2005 Ozawa ..... 704/221

FOREIGN PATENT DOCUMENTS

WO WO 97/15916 5/1997
WO WO 99/04506 1/1999

OTHER PUBLICATIONS

Copy of International Search Report dated Aug. 13, 2002.
Copy of Australian Examination Report dated Nov. 6, 2003.

* cited by examiner

*Primary Examiner*—Daniel Abebe
(74) *Attorney, Agent, or Firm*—Snell & Wilmer L.L.P.

(57) ABSTRACT

An encoding apparatus includes a band gain encoding section for calculating an average amplitude of a frequency spectrum stream corresponding to each of a plurality of frequency bands so as to generate a first code representing the average amplitude of the frequency spectrum stream; an encoding band determination section for determining at least one frequency band, for which the corresponding frequency spectrum stream is to be quantized and encoded from among the plurality of frequency bands; a spectrum encoding section for quantizing and encoding the frequency spectrum stream of each of the at least one frequency band determined by the encoding band determination section so as to generate a second code; and an encoded stream generation section for generating an encoded stream based on the first code and the second code.

18 Claims, 12 Drawing Sheets

ENCODING APPARATUS AND DECODING APPARATUS

BACKGROUND OF THE INVENTION

1. Field of the Invention

The present invention relates to an encoding apparatus and a decoding apparatus, and in particular, to an encoding apparatus for encoding an audio signal into an encoded stream having a reduced amount of information while still maintaining the same sound quality of the audio signal, and a decoding apparatus for decoding the encoded data stream.

2. Description of the Related Art

A number of encoding methods and decoding methods for an audio signal containing a speech and/or music signal have been developed to date. Among others, a method in conformity with IS13818-7, which is internationally standardized by the ISO/IEC, has recently been acknowledged and evaluated as a high sound-quality and efficient encoding method. This encoding method is referred to as AAC.

Recently, AAC has been adopted by the standard referred to as MPEG4. MPEG4-AAC, which has several extended functions over IS13818-7 is now defined. An example of the encoding process of MPEG4-AAC is described in INFOMATIVE PART.

FIG. 10 is a diagram showing a structure of a conventional encoding apparatus 1000. A frequency spectrum stream is input to the encoding apparatus 1000. The frequency spectrum stream is generated as follows.

An audio signal is input to a time-frequency transformation section (not shown) in the form of an audio discrete signal obtained by sampling the audio signal. The time-frequency transformation section transforms a discrete signal on a time axis into a spectrum on a frequency axis by, for example, orthogonal transformation. Herein, the entirety of a spectrum on the frequency axis obtained by transformation from the discrete signal on the time axis is referred to as a "one-frame frequency spectrum". A one-frame frequency spectrum is divided into a plurality of frequency spectra respectively corresponding to a plurality of frequency bands. A frequency spectrum stream is input to the encoding apparatus 1000.

The encoding apparatus 1000 includes a spectrum amplification section 1010, a spectrum quantization section 1020, a Huffman encoding section 1030, and an encoded stream generation section 1040.

The spectrum amplification section 1010 receives a frequency spectrum stream representing a frequency spectrum corresponding to a prescribed frequency band among the plurality of frequency bands, and amplifies the received frequency spectrum using a prescribed gain so as to generate an amplified spectrum stream. The spectrum amplification section 1010 also encodes the prescribed gain so as to generate an encoded gain.

The spectrum quantization section 1020 quantizes data of the amplified spectrum stream using a prescribed transformation formula so as to generate a quantized spectrum stream. In the case of the AAC method, the spectrum quantization section 1020 performs quantization by rounding off the data of the amplified spectrum-stream, which is represented by a floating-point part, into an integer.

The Huffman encoding section 1030 Huffman-encodes a plurality of data units in the quantized spectrum stream so as to generate a Huffman-encoded spectrum stream.

The encoded stream generation section 1040 generates an encoded stream including the encoded gain and the Huffman-encoded spectrum stream, and transfers the encoded stream to the decoding apparatus (not shown).

The conventional encoding apparatus 1000 having the above-described structure has the following problems.

Recently, there is a demand to reduce the amount of information of an encoded stream obtained by encoding an audio signal so as to enhance the compression ratio of the audio signal.

In the encoding apparatus 1000, the compression ratio of information relies on the Huffman encoding section 1030. More specifically, in order to encode an audio signal at a higher compression ratio into a data stream having a reduced amount of information, the gain of the spectrum amplification section 1010 is controlled to reduce a data value of the quantized spectrum stream and thus to reduce the amount of information to be encoded by the Huffman encoding section 1030.

However, such an operation results in a phenomenon where a frequency spectrum obtained by decoding the Huffman-encoded spectrum stream exhibits the amplitude value (quantized value) of zero over a wide frequency range. This means a sufficiently high sound quality cannot be obtained.

SUMMARY OF THE INVENTION

According to one aspect of the invention, an encoding apparatus includes a band gain encoding section for calculating an average amplitude of a frequency spectrum stream corresponding to each of a plurality of frequency bands so as to generate a first code representing the average amplitude of the frequency spectrum stream; an encoding band determination section for determining at least one frequency band, for which the corresponding frequency spectrum stream is to be quantized and encoded from among the plurality of frequency bands; a spectrum encoding section for quantizing and encoding the frequency spectrum stream of each of the at least one frequency band determined by the encoding band determination section so as to generate a second code; and an encoded stream generation section for generating an encoded stream based on the first code and the second code.

In one embodiment of the invention, the encoding band determination section determines whether or not the frequency spectrum stream corresponding to each of the plurality of frequency bands is to be quantized and encoded, based on the size of the first code representing the average amplitude of the frequency spectrum stream.

In one embodiment of the invention, the encoding band determination section re-determines a frequency band, for which a corresponding frequency spectrum stream is to be quantized and encoded, among the frequency bands which were not determined to be quantized or encoded, the re-determination being performed based on the size of the second code generated by the spectrum encoding section for the at least one frequency band determined to be quantized and encoded. The spectrum encoding section quantizes and encodes the frequency spectrum stream for the re-determined frequency band so as to generate a second code.

In one embodiment of the invention, the encoded stream generation section generates the encoded stream based on a third code representing the frequency band determined by the encoding band determination section, the first code, and the second code.

In one embodiment of the invention, the spectrum encoding section performs Huffman encoding.

In one embodiment of the invention, the spectrum encoding section performs vector quantization.

In one embodiment of the invention, the spectrum encoding section performs Huffman encoding and vector quantization.

In one embodiment of the invention, the encoding apparatus further includes a time region gain encoding section for calculating an average amplitude of a time signal stream, corresponding to each of a plurality of time regions, which is to be transformed into a frequency spectrum stream of each of the plurality of frequency bands, so as to generate a fourth code representing the average amplitude of the time signal stream.

In one embodiment of the invention, the encoding apparatus further includes a sub-band gain encoding section for generating a fifth code representing an average amplitude of each of a plurality of sub-bands, which are obtained by dividing at least one frequency band among frequency bands, for which a corresponding frequency spectrum stream is determined not to be quantized or encoded.

In one embodiment of the invention, at least one of the plurality of sub-bands includes two or more frequency spectrum streams.

According to another aspect of the invention, a decoding apparatus for decoding an encoded stream including a first code and at least one second code is provided. The first code is generated so as to represent an average amplitude of a frequency spectrum stream of one of a plurality of frequency bands. Each of the at least one second code is generated by quantizing and encoding the frequency spectrum stream of the one of the frequency bands. The decoding apparatus includes an encoded stream analysis section for analyzing the encoded stream so as to detect the first code and the at least one second code; a band gain de-quantization section for de-quantizing the first code detected by the encoded stream analysis section into the average amplitude of the frequency spectrum stream; an encoding band notification section for notifying whether or not the frequency band corresponding to the at least one second code includes a frequency band corresponding to the first code; a spectrum de-quantization section for de-quantizing and decoding the second code into the frequency spectrum stream based on the notification by the encoding band notification section that the frequency band corresponding to the at least one second code includes a frequency band corresponding to the first code; a noise spectrum stream generation section for generating a noise spectrum stream based on the notification by the encoding band notification section that the frequency band corresponding to the at least one second code does not include any frequency band corresponding to the first code; and an amplification section for amplifying the frequency spectrum stream or the noise spectrum stream based on the average amplitude.

In one embodiment of the invention, the encoded stream further includes a third code representing a frequency band, for which a corresponding frequency spectrum stream has been quantized and encoded. The encoding band notification section decodes the third code, and notifies whether or not the frequency band corresponding to the at least one second code includes a frequency band corresponding to the first code, based on the decoded third code.

In one embodiment of the invention, the spectrum de-quantization section performs Huffman decoding.

In one embodiment of the invention, the spectrum de-quantization section performs vector de-quantization.

In one embodiment of the invention, the spectrum de-quantization section performs Huffman decoding and vector de-quantization.

In one embodiment of the invention, the encoded stream further includes a fourth code representing an average amplitude of a time signal stream of each of a plurality of time regions, which is to be transformed into a frequency spectrum stream of each of the plurality of frequency bands. The decoding apparatus further comprises a time gain region decoding section for decoding the fourth code into the average amplitude of the time signal stream.

In one embodiment of the invention, the noise spectrum stream generation section generates a noise spectrum stream to be converted into a noise signal of each of the plurality of time regions, based on the fourth code decoded by the time gain region decoding section.

In one embodiment of the invention, the encoded stream further includes a fifth code representing an average amplitude of each of a plurality of sub-bands which are obtained by dividing at least one frequency band among frequency bands, for which a corresponding frequency spectrum stream is not to be de-quantized. The decoding apparatus further comprises a sub-band gain decoding section for decoding the fifth code into the average amplitude of the sub-band and generates a noise spectrum stream for each of the plurality of sub-bands based on the decoded average amplitude.

Thus, the invention described herein makes possible the advantages of providing an encoding apparatus for encoding a frequency spectrum stream corresponding to an audio signal into an encoded stream having a reduced amount of information while maintaining the sound quality of the audio signal, and a decoding apparatus for decoding the encoded stream into an output spectrum stream corresponding to a decoded audio signal.

These and other advantages of the present invention will become apparent to those skilled in the art upon reading and understanding the following detailed description with reference to the accompanying figures.

DESCRIPTION OF THE EMBODIMENTS

Hereinafter, an encoding apparatus, a decoding apparatus, and a data processing system including the encoding apparatus and the decoding apparatus according to the present invention will be described by way of illustrative examples with reference to the accompanying drawings.

EXAMPLE 1

Figure 1:
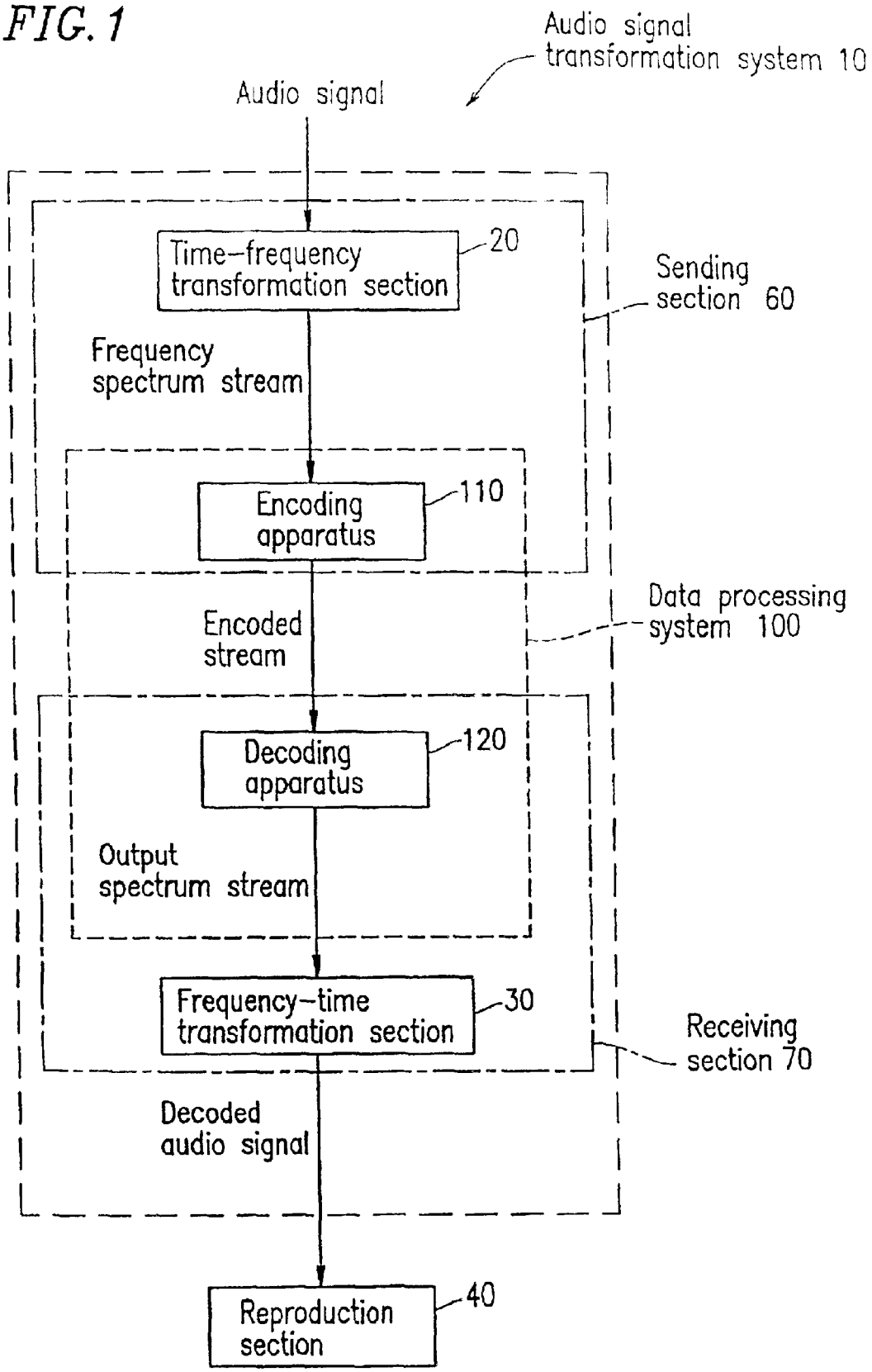
FIG. 1 shows an exemplary structure of an audio signal transformation system including an encoding apparatus 110 and a decoding apparatus 120 according to the present invention.

FIG. 1 shows an exemplary structure of an audio signal transformation system 10 including an encoding apparatus and a decoding apparatus according to a first example of the present invention.

The audio signal transformation system 10 includes a time-frequency transformation section 20 for transforming an audio signal into a frequency spectrum stream, a data processing system 100 for encoding the frequency spectrum stream into an encoded stream having a reduced amount of information and for decoding the encoded stream so as to generate an output spectrum stream, and a frequency-time transformation section 30 for transforming the output spectrum stream into a decoded audio signal. The decoded audio signal is reproduced by a reproduction section 40.

The data processing system 100 includes an encoding apparatus 110 for encoding the frequency spectrum stream into an encoded stream and a decoding apparatus 120 for decoding the encoded stream into an output spectrum stream.

In the audio signal transformation system 10, the time-frequency transformation section 20 and the encoding apparatus 110 act together as a sending section 60. The decoding apparatus 120 and the frequency-time transformation section 30 act together as a receiving section 70. An encoded stream output from the sending section 60 is temporarily recorded by arbitrary recording means, and decoded and reproduced when desired. Alternatively, an encoded stream output from the sending section 60 is sent to the receiving section 70 via a transmission path (not shown).

An audio signal is input to the time-frequency transformation section 20 in the form of an audio discrete signal obtained by sampling the audio signal. The audio discrete signal is represented by a discrete signal on a time axis. The time-frequency transformation section 20 transforms a discrete signal on the time axis into a spectrum on a frequency axis at a certain time interval. Herein, the entirety of a discrete signal on the time axis over a certain time interval is referred to as a "one-frame time signal". A spectrum on a frequency axis obtained by transforming the one-frame time signal is referred to as a "one-frame frequency spectrum". A one-frame time signal is represented as one-frame time signal stream. The one-frame frequency spectrum is divided into a plurality of frequency spectra respectively corresponding to a plurality of frequency bands. Herein, each of the plurality of frequency bands is referred to as a scale factor band. Data units on a plurality of frequency spectra are included in each scale factor band, and each data unit is input to the encoding apparatus 110.

The time-frequency transformation section 20 performs time-frequency transformation by, for example, modified discrete cosine transformation (MDCT). MDCT is known in the art. The time-frequency transformation section 20 performs time-frequency transformation for each of a specified number of samples (for example, each 512 samples or each 1024 samples). In the case where the number of samples (i.e., the number of the time signal streams) is 512 and MDCT is used for time-frequency transformation, MDCT coefficients for 512 samples are obtained for each frame. In the following description, it is assumed that MDCT is used and the entirety of the MDCT coefficients is one-frame frequency spectrum.

Figure 2A:
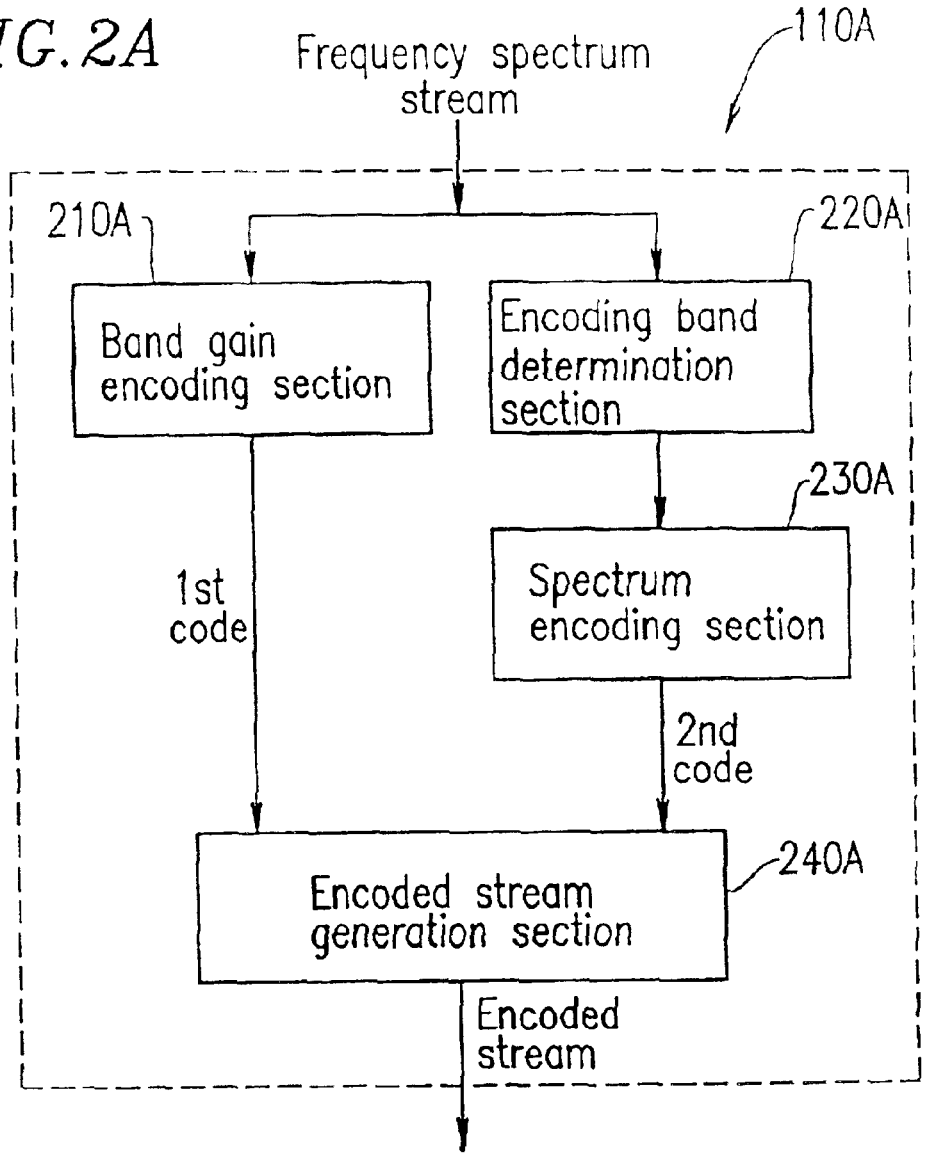
FIG. 2A shows a structure of an example of the encoding apparatus 110 shown in FIG. 1.

FIG. 2A shows a structure of an encoding apparatus 110A, which is an example of the encoding apparatus 110 shown in FIG. 1. The encoding apparatus 110A receives a frequency spectrum stream and generates an encoded stream.

The encoding apparatus 110A includes a band gain encoding section 210A, an encoding band determination section 220A, a spectrum encoding section 230A, and an encoded stream generation section 240A. The band gain encoding section 210A calculates an average amplitude of the frequency spectrum stream and generates a first code which represents the average amplitude of the frequency spectrum stream. The encoding band determination section 220A determines at least one frequency band, among the plurality of frequency bands, for which a corresponding frequency spectrum stream is to be quantized and encoded. The spectrum encoding section 230A quantizes and encodes the frequency spectrum stream of each of the at least one frequency band determined by the encoding band determination section 220A so as to generate a second code. The encoded stream generation section 240A generates an encoded stream based on the first code generated by the band gain encoding section 210A and the second code generated by the spectrum encoding section 230A.

The operation of each section of the encoding apparatus 110A will be described in more detail.

The band gain encoding section 210A calculates an average amplitude rms of a frequency spectrum stream corresponding to each scale band using, for example, expression (1).

$$rms = \sqrt{\frac{1}{n}\sum_{i=0}^{n-1} sp(i) * sp(i)} \tag{1}$$

where sp(i) represents a value of each of data units in the frequency spectrum stream corresponding to the scale factor band, and n represents the number of data units in the frequency spectrum stream corresponding to the scale factor band.

The band gain encoding section 210A quantizes and encodes the average amplitude rms obtained for each scale factor band.

The encoded average amplitude (index) is given by, for example, expression (2).

$$\text{index}=(int)\{2*\log2(rms)-1\} \tag{2}$$

where (int) represents a function for rounding off the value after the decimal point and making the value of the amplitude an integer, and log2 is the logarithm of 2.

The quantized average amplitude (qrms) is given by, for example, expression (3).

$$qrms=2((\text{index}+2)/2) \tag{3}$$

where represents a function for index calculation.

When a one-frame frequency spectrum is divided into M frequency spectra (when a one-frame frequency spectrum includes M scale factor bands), a maximum of M quantized average amplitudes are obtained. The encoded stream generation section 240A may generate an encoded stream using codes representing all the M average amplitudes. Alternatively, the encoded stream generation section 240A may generate an encoded stream using codes representing a smaller-than-M number of average amplitudes, the number being counted from the lowest frequency band. Still alternatively, the encoded stream generation section 240A may generate an encoded stream based on a code representing one average amplitude and other information. An encoded stream may be generated by directly encoding the code obtained by expression (2), or the difference between the average amplitudes of adjacent scale factor bands may be encoded using Huffman encoding or the like.

The encoding band determination section 220A determines at least one frequency band (or scale factor band), among the plurality of frequency bands, for which a corresponding frequency spectrum stream is to be quantized and encoded by the spectrum encoding section 230A. The scale factor band(s) may be preset as, for example, N scale factor bands from the lowest frequency band.

In this example, frequency spectrum streams corresponding to N scale factor bands from the lowest frequency band, among the M scale factor bands, are preset to be quantized and encoded. M and N are both natural numbers, and M is equal to or larger than N. The reason why the N scale factor bands from the lowest frequency band are preset is because human auditory sense is more influenced by lower frequency bands than higher frequency bands when listening to a reproduced audio signal.

The spectrum encoding section 230A quantizes and encodes the frequency spectrum streams corresponding to the scale factor bands determined by the encoding band determination section 220A. The spectrum encoding section 230A may use Huffman encoding or vector quantization. Alternatively, the spectrum encoding section 230A may use both Huffman encoding and vector quantization. Here, it is assumed that the type of encoding performed by the spectrum encoding section 230A is determined in advance. The present invention is not limited to this. The spectrum encoding section 230A may output information representing the type of quantization and encoding which was performed on the frequency spectrum stream to the encoded stream generation section 240A, and the encoded stream generation section 240A may include that information in the encoded stream.

The encoded stream generation section 240A generates an encoded stream based on the average amplitude generated by the band gain encoding section 210A and the encoded spectrum stream generated by the spectrum encoding section 230A. The encoded stream is generated in the form of a bit stream in accordance with a prescribed format. The encoded stream may be generated in any format known to those skilled in the art.

Figure 3:
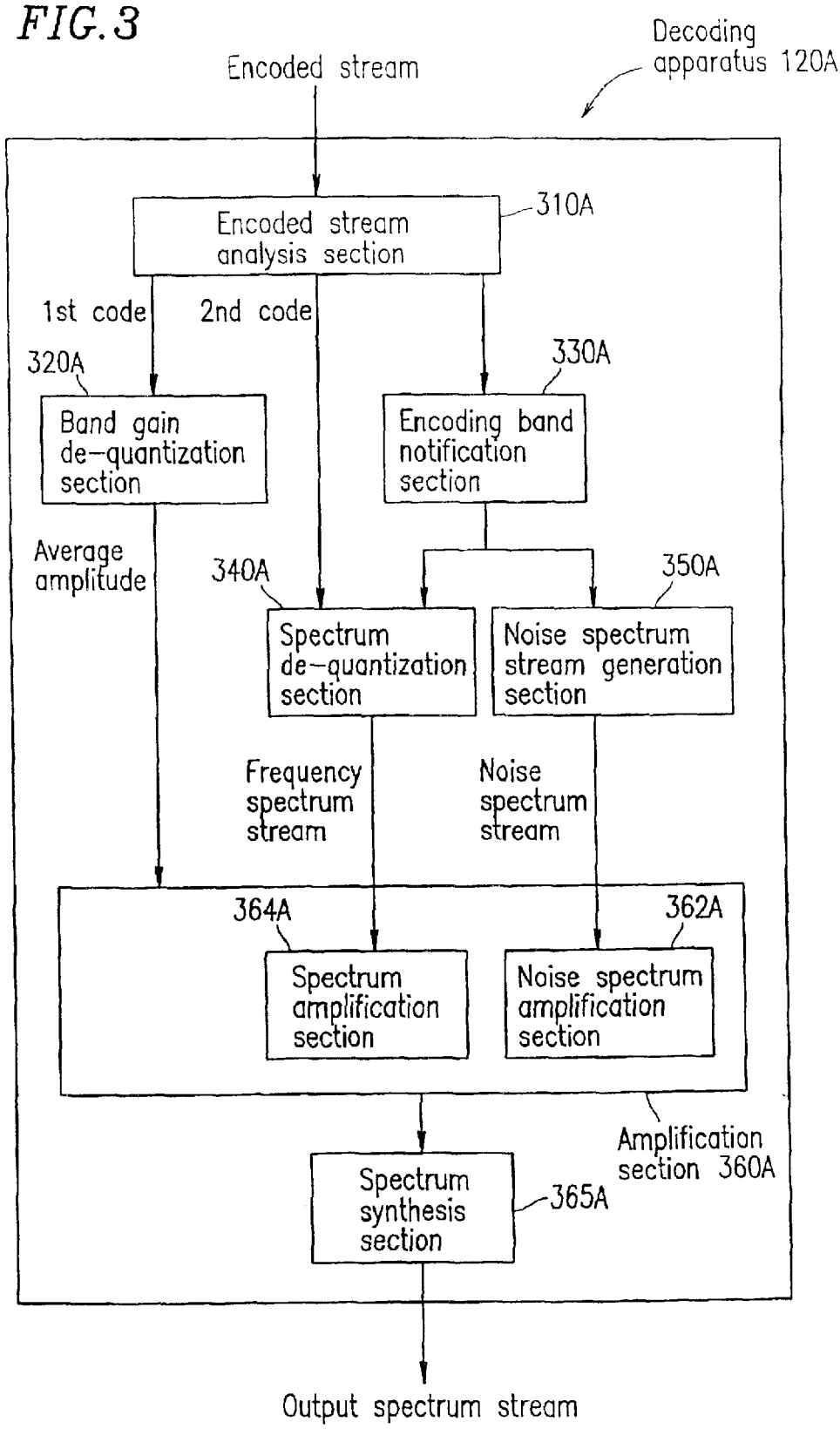
FIG. 3 shows a structure of an example of the decoding apparatus 120 shown in FIG. 1.

FIG. 3 shows a structure of a decoding apparatus 120A, which is an example of the decoding apparatus 120 shown in FIG. 1. The decoding apparatus 120A receives an encoded stream and generates an output spectrum stream.

An encoded stream includes a plurality of first codes and at least one second code. Each of the plurality of first codes is generated so as to represent an average amplitude of a frequency spectrum stream corresponding to one of the plurality of frequency bands. Herein, the term "first code" refers to a code generated so as to represent an average amplitude of a frequency spectrum stream corresponding to one of the plurality of frequency bands. The term "second code" refers to a code obtained by encoding the frequency spectrum stream corresponding to the average amplitude represented by the first code.

The encoded stream received by the decoding apparatus 120A is, for example, generated by the encoded stream generation section 240A in the encoding apparatus 110A described above. The output spectrum stream generated by the decoding apparatus 120A is transformed into a decoded audio signal, which is a time signal, by a frequency-time spectrum transformation section 30 (FIG. 1).

The decoding apparatus 120A includes an encoded stream analysis section 310A, a band gain de-quantization section 320A, an encoding band notification section 330A, a spectrum de-quantization section 340A, a noise spectrum stream generation section 350A, an amplification section 360A, and a spectrum synthesis section 365A. The encoded stream analysis section 310A analyzes the encoded stream including the plurality of first codes and the at least one second code. The band gain de-quantization section 320A de-quantizes each of the first codes so as to generate an average amplitude of each frequency spectrum stream. The encoding band notification section 330A notifies the spectrum de-quantization section 340A or the noise spectrum stream generation section 350A whether or not the frequency band corresponding to the at least one second code includes a frequency band corresponding to one of the first codes. The spectrum de-quantization section 340A de-quantizes each of the at least one second code into a frequency spectrum stream. The noise spectrum stream generation section 350A generates a noise spectrum stream. The amplification section 360A amplifies the frequency spectrum stream obtained by the spectrum de-quantization section 340A and the noise spectrum stream obtained by the noise spectrum stream generation section 350A. The spectrum synthesis section 365A synthesizes the amplified frequency spectrum stream and the amplified noise spectrum stream. The amplification section 360A includes a noise spectrum stream amplification section 362A for amplifying the noise spectrum stream and a frequency spectrum stream amplification section 364A for amplifying the frequency spectrum stream.

The operation of each section of the decoding apparatus 120A will be described in more detail.

The encoding stream analysis section 310A receives the encoded stream and analyzes the received encoded stream. The encoding stream analysis section 310A also outputs each of the first codes obtained by the analysis to the band gain de-quantization section 320A.

The band gain de-quantization section 320A generates a quantized decoded average amplitude qrms for each scale factor band based on the first code received from the encoding stream analysis section 310A. The quantized decoded average amplitude qrms is calculated by expression (3) above.

The encoding stream analysis section 310A sends, to the encoding band notification section 330A, information on whether or not the frequency band corresponding to the at least one second code includes a frequency band corresponding to one of the first codes. When the frequency band corresponding to the at least one second code includes a frequency band corresponding to one of the first codes, the encoding band notification section 330A notifies the spectrum de-quantization section 340A of that information. When the frequency band corresponding to the at least one second code does not include any frequency band corresponding to any of the first codes, the encoding band notification section 330A notifies the noise spectrum stream generation section 350A of that information. In this example, it is assumed that the encoded stream includes codes obtained by encoding frequency spectrum streams corresponding to N scale factor bands (i.e., frequency bands) from the lowest frequency band among the plurality of scale factor bands. The present invention is not limited to this.

When the encoding band notification section 330A notifies the spectrum de-quantization section 340A that the frequency band corresponding to the at least one second code includes a frequency band corresponding to one of the first codes, the spectrum de-quantization section 340A de-quantizes the second code received from the encoding stream analysis section 310A so as to generate a frequency spectrum stream. In the case where the second code is formed by Huffman encoding, the spectrum de-quantization section 340A performs Huffman decoding. In the case where the second code is formed by vector quantization, the spectrum de-quantization section 340A performs vector de-quantization. Here, it is assumed that the type of encoding performed on the second code is determined in advance. The present invention is not limited to this. The encoded stream may include a code representing the type by which the second code has been encoded, and the spectrum de-quantization section 340A may determine the type of decoding performed on the second code, based on the code included in the encoded stream.

The spectrum stream amplification section 364A of the amplification section 360A amplifies the frequency spectrum stream generated by the spectrum de-quantization section 340A using the average amplitude generated by the band gain de-quantization section 320A.

In the case where the average amplitude generated for one scale factor band is qrms and the frequency spectrum stream, corresponding to the scale factor band, generated by the spectrum de-quantization section 340A is qsp(i), the output from the spectrum amplification section 364A is given by expression (4).

$$rsp(i)=qrms*qsp(i) \tag{4}$$

When the encoding band notification section 330A notifies the noise spectrum stream generation section 350A that the frequency band corresponding to the at least one second code does not include any frequency band corresponding to any of the first codes, the noise spectrum stream generation section 350A outputs a noise spectrum to the noise amplification section 362A of the amplification section 360A. Herein, a "noise spectrum" refers to a spectrum on a frequency axis. The noise spectrum stream generation section 350A may use, as a noise spectrum, a spectrum obtained by processing a white noise signal prepared in advance with the same type of time-frequency transformation as the time-frequency transformation performed by the time-frequency transformation section 20 (FIG. 1). A frequency spectrum of a white noise signal is normalized so that the average amplitude obtained by expressions (1) through (3) is 1. Alternatively, the noise spectrum stream generation section 350A may store a value of the noise spectrum on some recording medium and simply output the value.

The noise spectrum amplification section 362A amplifies the noise spectrum stream generated by the noise spectrum stream generation section 350A using the average amplitude generated by the band gain de-quantization section 320A. The amplification is performed in a manner similar to that of expression (4).

As described above, when the frequency band corresponding to the at least one second code included in the encoded spectrum includes a frequency band corresponding to one of the first codes, the amplification section 360A amplifies a frequency spectrum stream based on the frequency spectrum stream generated by the spectrum de-quantization section 340A and the average amplitude generated by the band gain de-quantization section 320A.

When the frequency band corresponding to the at least one second code included in the encoded spectrum does not include any frequency band corresponding to any of the first codes, the amplification section 360A amplifies a noise spectrum stream based on the noise spectrum stream generated by the noise spectrum stream generation section 350A and the average amplitude generated by the band gain de-quantization section 320A.

The spectrum synthesis section 365A synthesizes the amplified noise spectrum stream and the amplified frequency spectrum stream so as to generate an output spectrum stream.

In summary, when the frequency band corresponding to the at least one second code includes a frequency band corresponding to one of the first codes, the encoding band notification section 330A instructs the spectrum de-quantization section 340A to de-quantize the second code to generate a decoded frequency spectrum stream. The spectrum de-quantization section 340A outputs the generated frequency spectrum stream to the spectrum amplification section 364A. The spectrum amplification section 364A amplifies the frequency spectrum stream using an average amplitude obtained by the band gain de-quantization section 320A as a result of de-quantization of the first code.

Alternatively, when the frequency band corresponding to the at least one second code does not include any frequency band corresponding to any of the first codes, the encoding band notification section 330A instructs the noise spectrum stream generation section 350A to output a noise spectrum stream. The noise spectrum stream generation section 350A outputs the generated noise spectrum stream to the noise spectrum amplification section 362A. The noise spectrum amplification section 362A amplifies the noise spectrum stream using an average amplitude obtained by the band gain de-quantization section 320A as a result of de-quantization of the first code.

Figure 4:
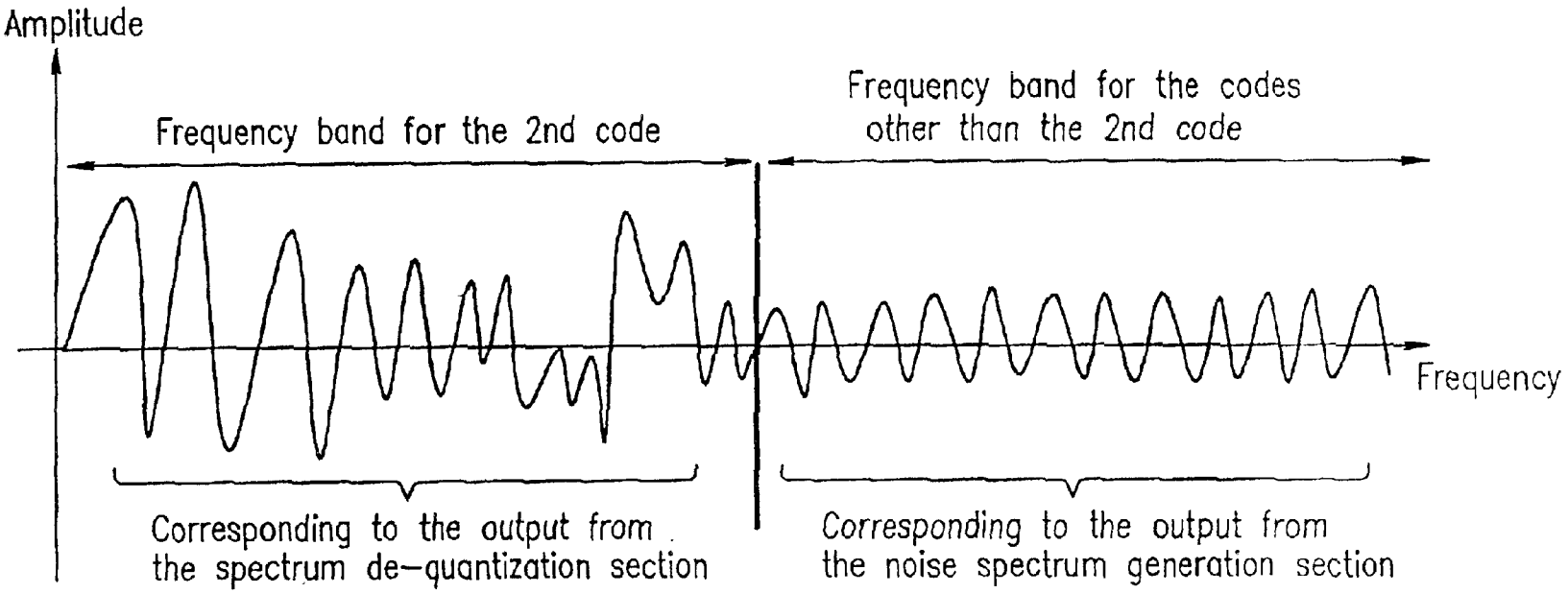
FIG. 4 is a graph illustrating an output spectrum represented by an output spectrum stream which is output by the decoding apparatus shown in FIG. 4.

FIG. 4 shows an output spectrum represented by an output spectrum stream which is output by the decoding apparatus 120A. In FIG. 4, the vertical axis represents the amplitude of the spectrum, and the horizontal axis represents the frequency.

FIG. 4 shows the frequency bands in a higher range and a lower range. In this example, the encoded stream includes second codes corresponding to a lower scale factor band. The present invention is not limited to the encoded stream including second codes being continuous from the lowest frequency band.

The output spectrum represented by the output spectrum stream which is output from the amplification section 360A is transformed by the frequency-time transformation section 30 (FIG. 1) into a decoded audio signal, which is a time signal stream.

In the above-described example, the scale factor bands, for which a corresponding frequency spectrum stream is to be quantized and encoded by encoding apparatus 110A, and the scale factor band, for which a corresponding frequency spectrum stream to be decoded by the decoding apparatus 120A, are preset. The present invention is not limited to this. The scale factor band, for which a corresponding frequency spectrum stream is to be quantized and encoded by encoding apparatus 110A, may be determined by the amount of information of the average amplitude or the encoded spectrum stream. The scale factor band, for which a corresponding frequency spectrum stream is to be decoded by the decoding apparatus 120A, may be determined by the code included in the encoded stream.

Figure 2B:
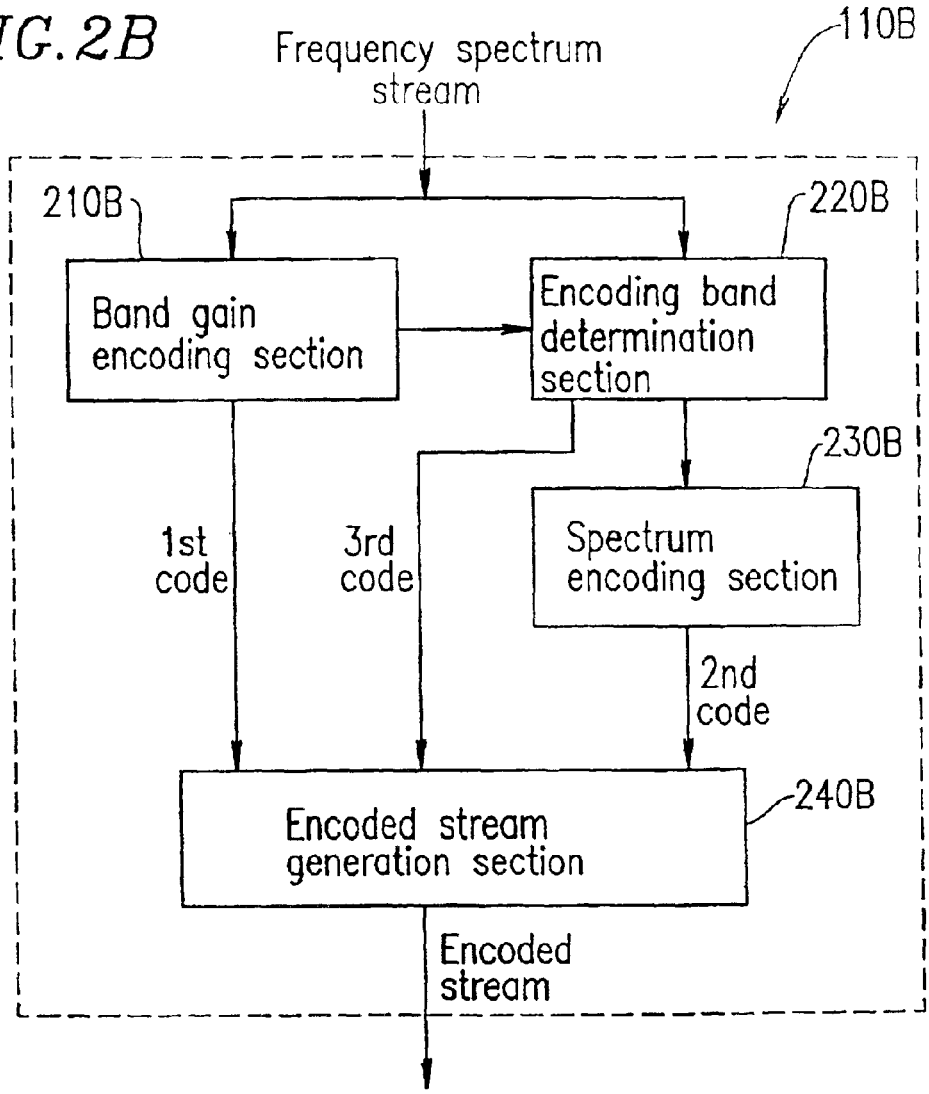
FIG. 2B shows a structure of another example of the encoding apparatus 110 shown in FIG. 1.

FIG. 2B shows a structure of an encoding apparatus 110B, which is an example of the encoding apparatus 110 shown in FIG. 1.

The encoding apparatus 110B is identical with the encoding apparatus 110A shown in FIG. 2A except that a frequency band, for which a corresponding frequency spectrum stream is to be quantized and encoded, is determined by the encoding band determination section 220B based on the amount of information of the encoded stream used by the band gain encoding section 210B to represent the average amplitude of each scale factor band, and that the encoded stream generation section 240B generates an encoded stream including the code representing the frequency band determined by the encoding band determination section 220B. The band gain encoding section 210B, the encoding band determination section 220B, a spectrum encoding section 230B, and the encoded stream generation section 240B of the encoding apparatus 110B respectively correspond to the band gain encoding section 210A, the encoding band determination section 220A, the spectrum encoding section 230A, and the encoded stream generation section 240A of the encoding apparatus 110A (FIG. 2A).

The operation of the encoding apparatus 110B will be described in more detail.

The encoding band determination section 220B determines the number of scale factor bands, for which a corresponding frequency spectrum stream is to be quantized and encoded by the spectrum encoding section 230B, based on the amount of information of the encoded stream used by the band gain encoding section 210B to represent the average amplitude of each scale factor band.

For example, when the amount of information of the encoded stream used to represent the average amplitude of at least one scale factor band is larger than a threshold, the encoding band determination section 220B decreases the number of scale factor bands, for which a corresponding frequency spectrum stream is to be quantized and encoded by the spectrum encoding section 230B. By contrast, when the amount of information of the encoded stream used to represent the average amplitude of at least one scale factor band is smaller than a threshold, the encoding band determination section 220B increases the number of scale factor bands, for which a corresponding frequency spectrum stream is to be quantized and encoded by the spectrum encoding section 230B.

Thus, the encoding band determination section 220B can control the number of scale factor bands, for which a corresponding frequency spectrum stream is to be quantized and encoded by the spectrum encoding section 230B, based on the result of the encoding performed by the band gain encoding section 210B.

The encoded stream generation section 240B generates an encoded stream based on the average amplitude generated by the band gain encoding section 210B (first code), the encoded spectrum stream generated by the spectrum encoding section 230B (second code), and also the code representing the scale factor bands determined by the encoding band determination section 220B (third code).

Figure 2C:
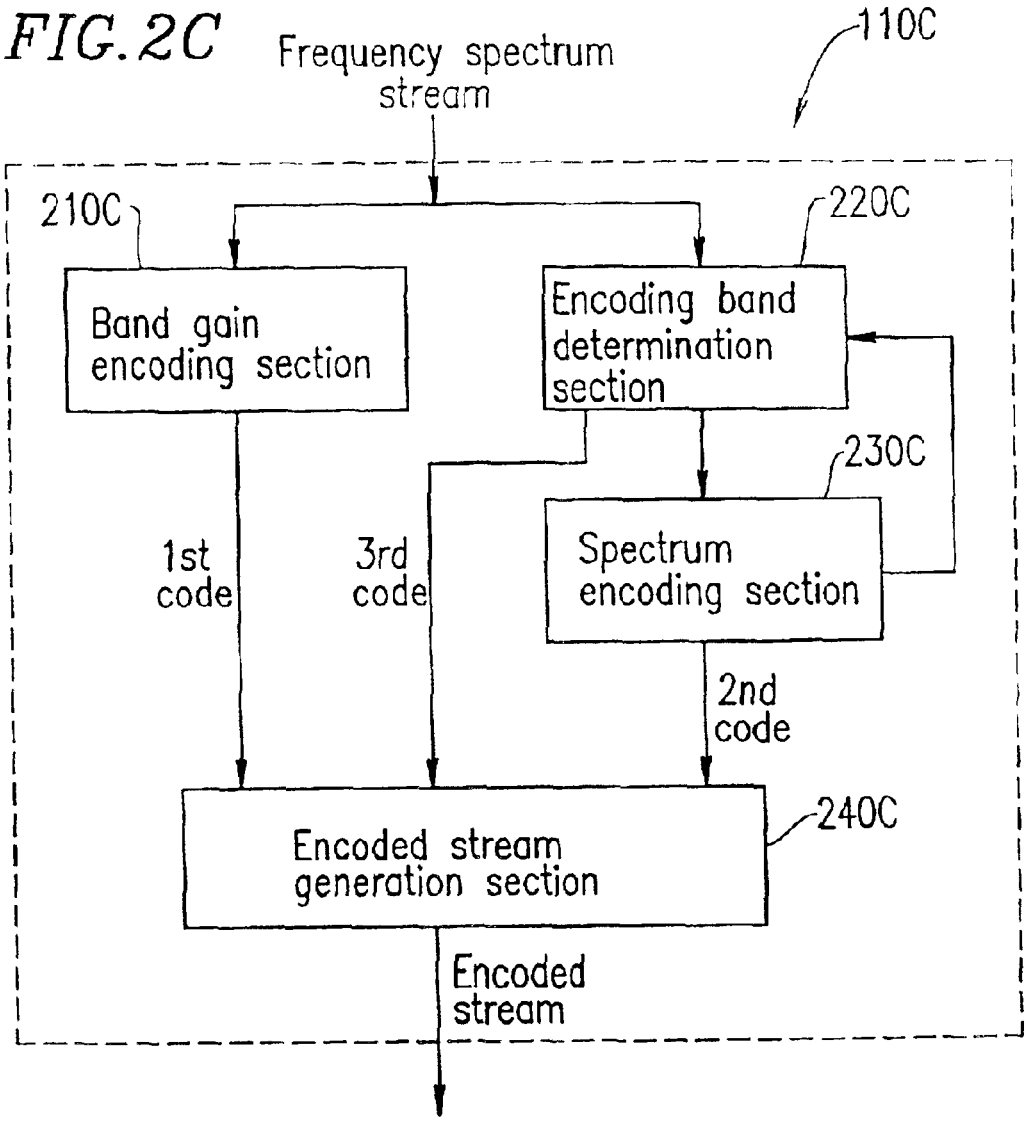
FIG. 2C shows a structure of still another example of the encoding apparatus 110 shown in FIG. 1.

FIG. 2C shows a structure of an encoding apparatus 110C, which is an example of the encoding apparatus 110 shown in FIG. 1.

The encoding apparatus 110C is identical with the encoding apparatus 110A shown in FIG. 2A except that a frequency band, for which a corresponding frequency spectrum stream is to be quantized and encoded, is determined by the encoding band determination section 220C based on the amount of information of the encoded stream used by the spectrum encoding section 230C to represent the encoded spectrum stream, and that the encoded stream generation section 240C generates an encoded stream including the code representing the frequency band determined by the encoding band determination section 220C. A band gain encoding section 210C, the encoding band determination section 220C, the spectrum encoding section 230C, and the encoded stream generation section 240C of the encoding apparatus 110C respectively correspond to the band gain encoding section 210A, the encoding band determination section 220A, the spectrum encoding section 230A, and the encoded stream generation section 240A of the encoding apparatus 110A (FIG. 2A).

For example, when the size of the encoded stream is preset and the spectrum encoding section 230C performs Huffman encoding, the encoding band determination section 220C determines to Huffman-encode all of the plurality of frequency bands sequentially from the lowest frequency band. When it is impossible to Huffman-encode all of the plurality of frequency bands due to the restriction on the size of the encoded stream, the encoding band determination section 220C determines not to Huffman-encode the frequency bands higher than a certain frequency band. In this case also, the encoded stream generation section 240C generates an encoded stream based on the average amplitude generated by the band gain encoding section 210C (first code), the encoded spectrum stream generated by the spectrum encoding section 230C (second code), and also the code representing the scale factor bands determined by the encoding band determination section 220C (third code).

Alternatively, it is conceivable that the encoding band determination section 220C pre-determines a frequency band, a frequency spectrum stream corresponding to which is to be quantized and encoded. In this case, a frequency band, for which a corresponding frequency spectrum stream is to be quantized and encoded, may be re-determined among the frequency bands which were originally not determined to be quantized and encoded, based on the size of the second code obtained by quantizing and encoding the frequency spectrum stream of the pre-determined frequency band. The spectrum encoding section 230C quantizes and encodes a frequency spectrum stream of the re-determined frequency band so as to generate another second code.

As shown in FIGS. 2B and 2C, the encoded stream may include a third code representing the scale factor band, for which a corresponding frequency spectrum stream has been encoded.

In such a case, the decoding apparatus 120 operates as described below using the decoding apparatus 120A (FIG. 3) as an example.

The encoded stream analysis section 310A analyzes the third code. The encoding band notification section 330A decodes the information indicating which scale factor band has been encoded, based on the third code obtained by analysis performed by the encoded stream analysis section 310A. Based on the decoding result, the encoding band notification section 330A notifies the spectrum de-quantization section 340A of the scale factor bands, for which a corresponding frequency spectrum stream has been encoded. Or the encoding band notification section 330A notifies the noise spectrum stream generation section 350A that the frequency band corresponding to each first code does not include any frequency band corresponding to the second code.

Based on the result obtained from the encoding band notification section 330A, the spectrum de-quantization section 340A decodes the frequency spectrum stream corresponding to each of the scale factor bands determined to have been encoded by the encoding band notification section 330A. In the case where the second code is obtained by Huffman encoding, the spectrum de-quantization section 340A performs Huffman decoding on the second code. In the case where the second code is obtained by vector quantization, the spectrum de-quantization section 340A performs vector de-quantization on the second code.

The amplification section 360A amplifies the decoded frequency spectrum stream generated by the spectrum de-quantization section 340A using the average amplitude obtained by the band gain de-quantization section 320A.

The encoded stream obtained in an encoding apparatus according to the present invention, although having a reduced amount of data, can be decoded into an audio signal including data over a wide frequency range. According to the present invention, detailed waveforms of spectra corresponding to all the frequency bands in a wide range are not encoded, but instead, for some of the frequency bands, only an average amplitude thereof is encoded. Therefore, the obtained encoded stream has a reduced amount of data, but is decoded into an audio signal holding the average amplitude of each frequency band of the input audio signal. Therefore, the decoded audio signal can be reproduced into a clear sound which does not give the listener the impression of the sound being confined, unlike a sound obtained from a signal of a narrow frequency range.

EXAMPLE 2

An encoding apparatus and a decoding apparatus according to a second example of the present invention is different from the first example in that (i) a one-frame time signal stream representing an audio signal is divided into a plurality of time signal streams respectively corresponding to a plurality of time regions, and an average amplitude of a time signal stream corresponding to each time region is generated, and (ii) a fourth code representing the average amplitude of such a time signal stream is decoded.

Figure 5:
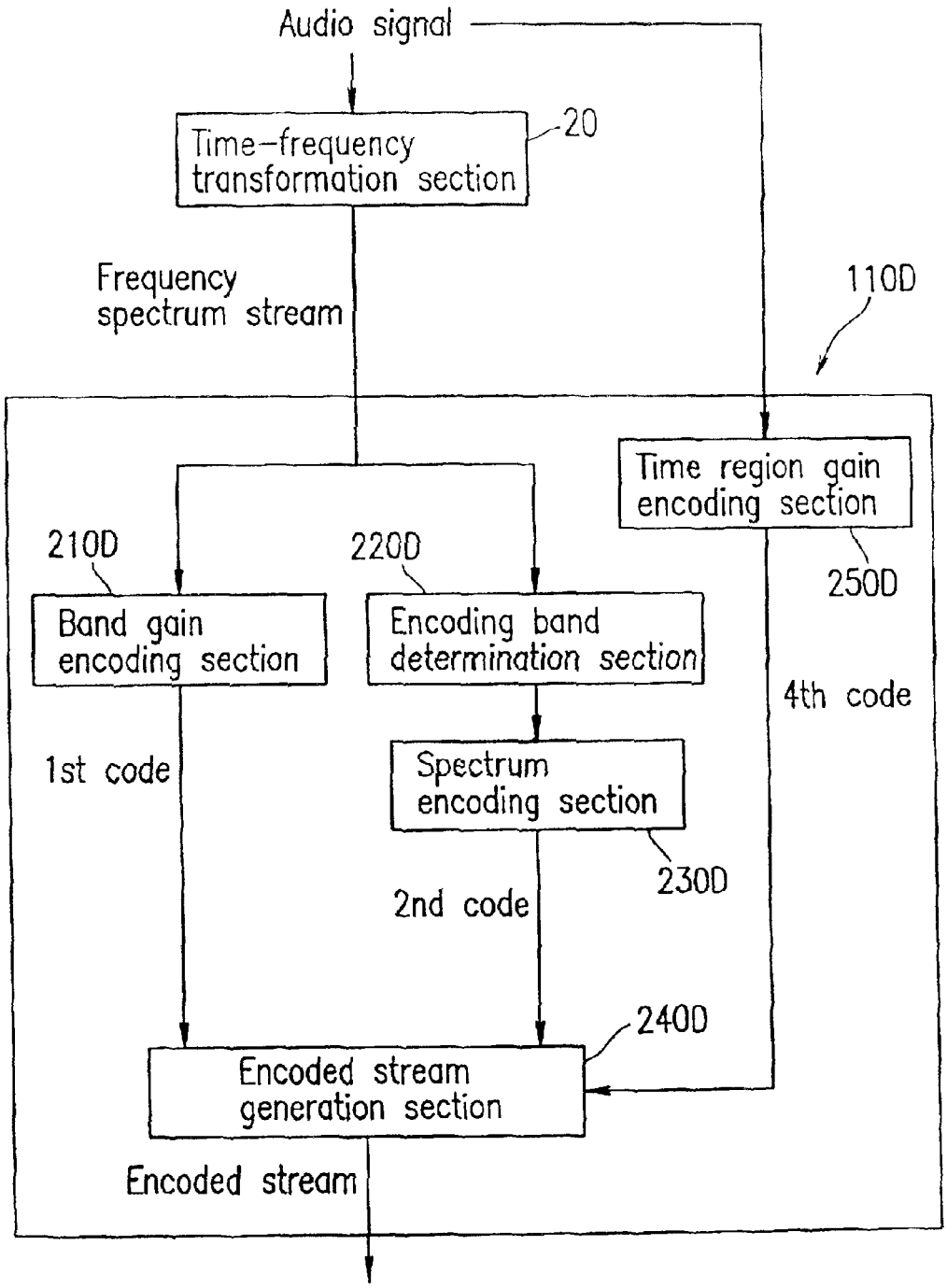
FIG. 5 shows a structure of still another example of the encoding apparatus 110 shown in FIG. 1.

FIG. 5 shows a structure of an encoding apparatus 110D, which is an example of the encoding apparatus 110 shown in FIG. 1.

The encoding apparatus 110D is identical with the encoding apparatus 110A shown in FIG. 2A except that a time region gain encoding section 250D for generating a fourth code representing an average amplitude of each time signal stream is further included and that the encoded stream generation section 240D generates an encoded stream including the fourth code. A band gain encoding section 210D, a encoding band determination section 220D, a spectrum encoding section 230D, and the encoded stream generation section 240D of the encoding apparatus 110D respectively correspond to the band gain encoding section 210A, the encoding band determination section 220A, the spectrum encoding section 230A, and the encoded stream generation section 240A of the encoding apparatus 110A (FIG. 2A).

An audio signal is input to the time-frequency transformation section 20 for each of a prescribed number of samples. The time-frequency transformation section 20 generates a spectrum on a frequency axis from the signal stream on a time axis using, for example, modified discrete cosine transformation (MDCT). As described above, the entirety of a spectrum on the frequency axis obtained by transformation from the spectrum on the time axis is referred to as a "one-frame frequency spectrum". The frequency spectrum is input to the band gain encoding section 210D and the encoding band determination section 220D as a frequency spectrum stream as described in the first example.

The audio signal is input to the time region gain encoding section 250D as an audio discrete signal at the same time interval as the audio signal is input to the time-frequency transformation section 20. The time region gain encoding section 250D divides the audio discrete signal into a plurality of continuous time regions.

For example, it is assumed that when the audio signal is represented by 512 continuous samples (i.e., in[i] (i=0, 1, 2, . . . 511), the time region gain encoding section 250D divides the audio signal into four time regions each having 128 samples. Data in a zeroth time region is in[i] where i is 0 through 127. Data in a first time region is in[i] where i is 128 through 255. Data in a second time region is in[i] where i is 256 through 383. Data in a third time region is in[i] where i is 384 through 511. The time region gain encoding section 250D calculates an average amplitude of each time region using, for example, expression (5).

$$g(j)=\sqrt{\sum_{i=j*128}^{(j+1)*128-1} in[i]*in[i]/128} \tag{5}$$

where j represents the number of the time region, and g[j] represents the average amplitude of the j'th time region.

Then, the time region gain encoding section 250D calculates an average amplitude ratio of each time region based on the average amplitude of each time region. For example, when the average amplitude having the maximum value of the average amplitudes of the four time regions is normalized to be 16, the average amplitude ratio of each time region is represented by 4 bits. The average amplitude normalized to be 16 is calculated by, for example, expression (6).

$$rg(j)=(int)\{g(j)/gmax*16\} \tag{6}$$

where rg(j) represents the quantized average amplitude of the j'th time region, and gmax represents the maximum value of g(j). The time region gain encoding section 250D encodes and sends the calculated rg(j) to the encoded stream generation section 240D. In the above example, rg(j) is obtained by normalizing the average amplitude having the maximum value to be 16 so that the average amplitude ratio of each time region is quantized by 4 bits. The present invention is not limited to this. The average amplitude ratio of each time region may be quantized by 1 bit instead of 4 bits. In this manner, the average amplitude of each time region can be represented by a prescribed amount of information by obtaining the average amplitude ratio of each time region.

In the above example, the average amplitude ratio of each time region is obtained, but the present invention is not limited to this. A value obtained by simply encoding the average amplitude of each time region may be sent to the encoded stream generation section 240D.

Figure 6:
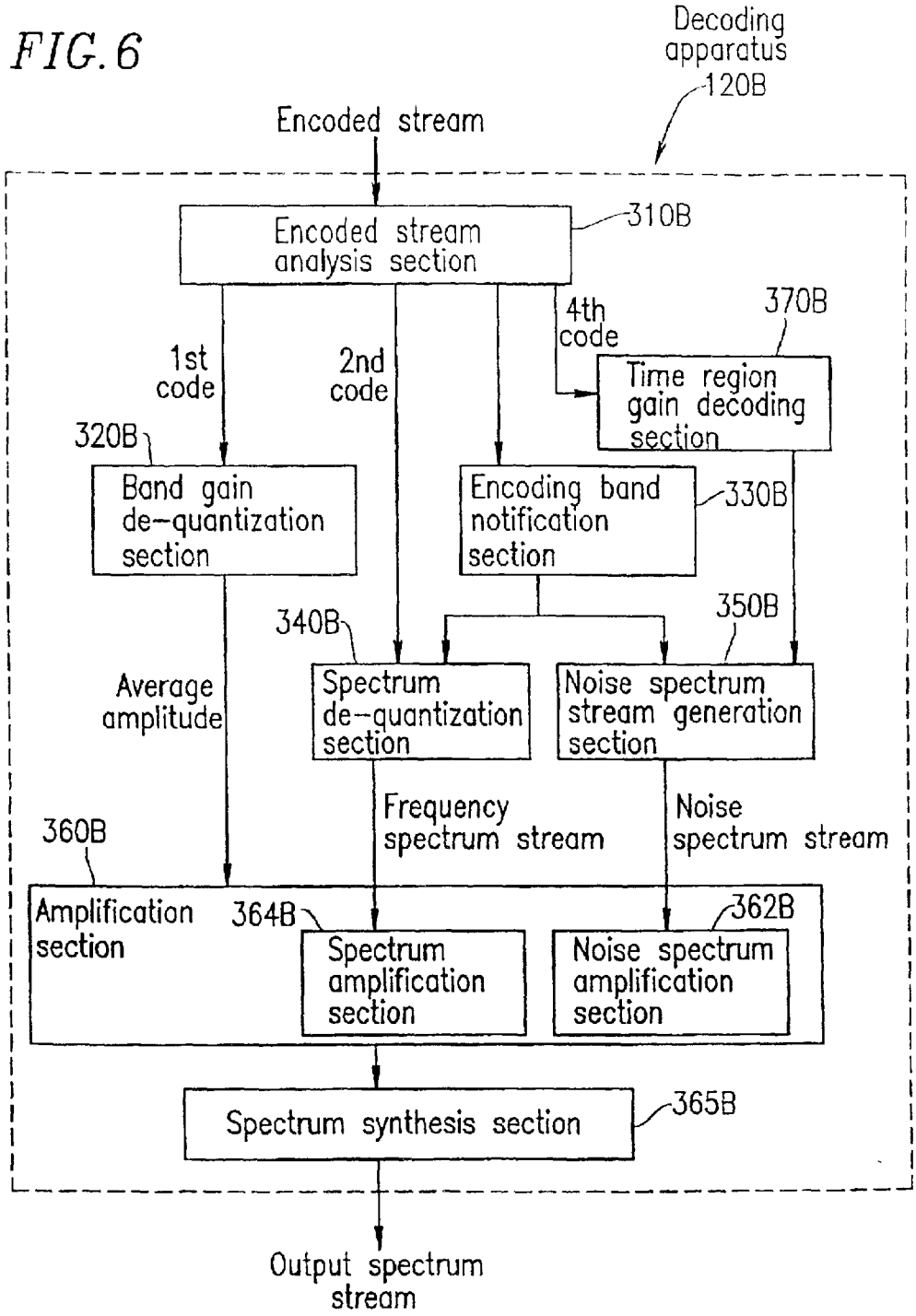
FIG. 6 shows a structure of another example of the decoding apparatus 120 shown in FIG. 1.

FIG. 6 shows a structure of a decoding apparatus 120B, which is an example of the decoding apparatus 120 shown in FIG. 1.

The decoding apparatus 120B is identical with the decoding apparatus 120A shown in FIG. 3 except that a time region gain decoding section 370B is further included. An encoding stream analysis section 310B, a band gain de-quantization section 320B, an encoding band notification section 330B, a spectrum de-quantization section 340B, a noise spectrum stream generation section 350B, an amplification section 360B, and a spectrum synthesis section 365B of the decoding apparatus 120B respectively correspond to the encoded stream analysis section 310A, the band gain de-quantization section 320A, the encoding band notification section 330A, the spectrum de-quantization section 340A, the noise spectrum stream generation section 350A, the amplification section 360A, and the spectrum synthesis section 365A of the decoding apparatus 120A (FIG. 3).

The encoding band notification section 330B receives an encoded stream including the fourth code representing an average amplitude of a time signal stream of each time region and analyzes the encoded stream. The time region gain decoding section 370B decodes the average amplitude of the time signal stream of each time region from the fourth code obtained by the analysis performed by the encoding band notification section 330B. The average amplitude of the time signal stream decoded from the fourth code is sent to the noise spectrum stream generation section 350B. The noise spectrum stream generation section 350B generates a noise spectrum stream to be converted into a noise signal of each of the plurality of time region, based on the fourth code decoded by the time region gain decoding section 370B.

In the case where the fourth code is a time region gain ratio rg(j) representing the average amplitude of each time region as described above with reference to expression (5), the noise spectrum stream generation section 350B generates a noise spectrum stream to be converted into a noise signal of each of the plurality of time regions, based on the time region gain ratio rg(j) decoded by the time region gain decoding section 370B. This processing corresponds to, for example, generation of an amplified noise signal as represented by expression (7).

$$an\ (i)=rg(j)*n(i) \text{ where } (i=0, 1, 2, \ldots 511)$$

$$\begin{cases} j=0 & (i=0, 1, 2, \ldots, 127) \\ j=1 & (i=128, 129, 130, \ldots, 255) \\ j=2 & (i=256, 257, 258, \ldots, 383) \\ j=3 & (i=384, 385, 386, \ldots, 511) \end{cases} \quad (7)$$

where n(i) represents a noise signal, and an (i) represents an amplified noise signal. The noise spectrum stream generation section 350B processes the amplified noise signal an(i) with a similar time-frequency transformation to that performed by the time-frequency transformation section 20 (FIG. 5), so as to generate a noise spectrum, and outputs the noise spectrum to the amplification section 360B. The operation performed after this is similar to that described in the first example. The noise spectrum stream generation section 350B may hold a value of the noise spectrum in advance in some recording medium and simply outputs the value when necessary.

The encoded stream obtained in an encoding apparatus according to the present invention, although having a reduced amount of data, can be decoded into an audio signal including data over a wide frequency range. According to the present invention, detailed waveforms of spectra corresponding to all the frequency bands in a wide range are not encoded, but instead, for some of the frequency bands, only an average amplitude thereof is encoded. Therefore, the obtained encoded stream has a reduced amount of data, but is decoded into an audio signal holding the average amplitude of each frequency band of the input audio signal. Therefore, the decoded audio signal can be reproduced into a clear sound which does not give the listener the impression of the sound being confined, unlike a sound obtained from a signal of a narrow frequency range. Since an average amplitude of each of a plurality of time regions is decoded, a clear and crisp sound can be reproduced.

EXAMPLE 3

An encoding apparatus and a decoding apparatus according to a third example of the present invention is different from the first example in that (i) a frequency band which is not to be quantized or encoded is divided into a plurality of sub-bands and an average amplitude of each sub-band is generated and (ii) a fifth code representing an average amplitude of a frequency spectrum stream of each sub-band is decoded.

Figure 7:
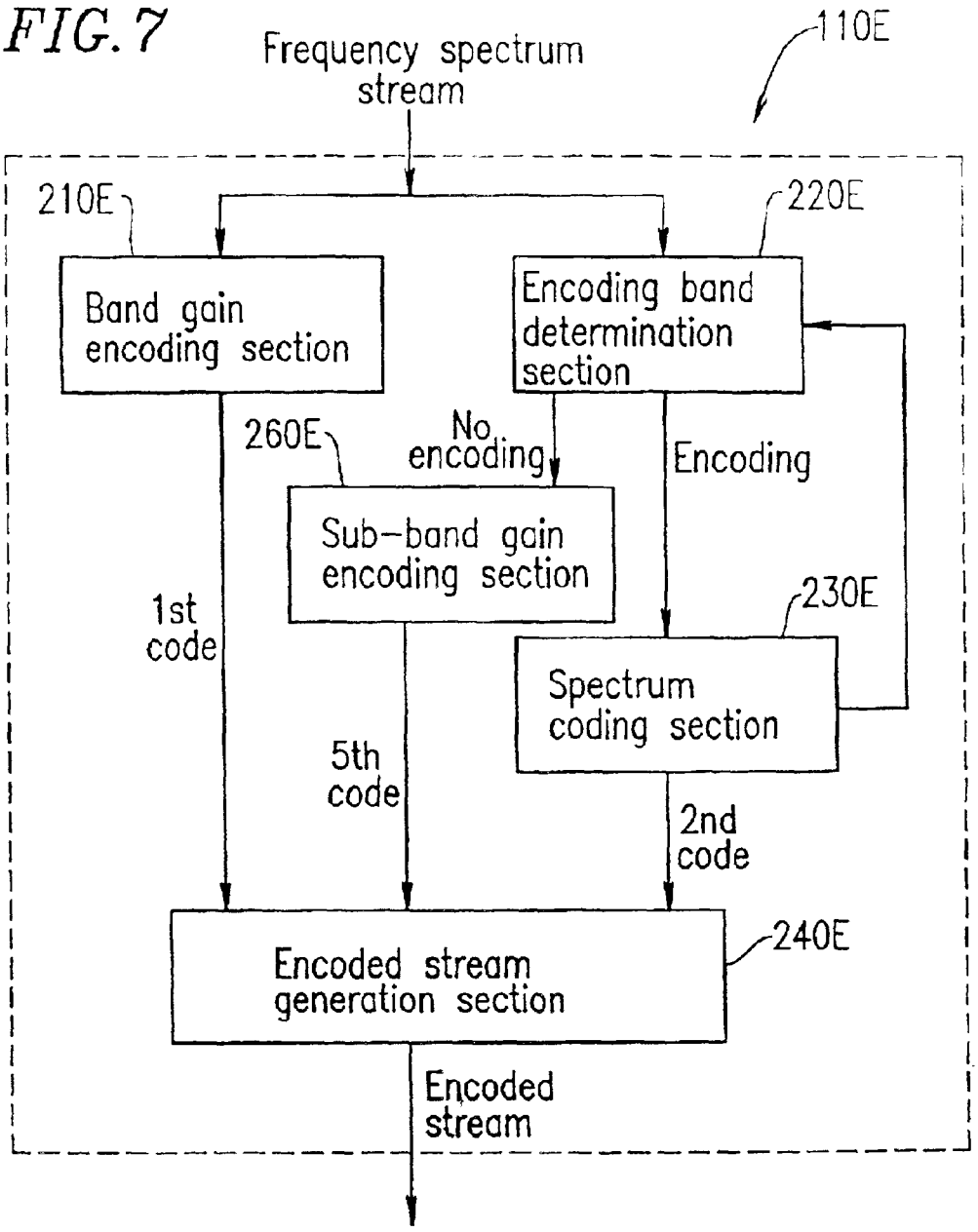
FIG. 7 shows a structure of still another example of the encoding apparatus 110 shown in FIG. 1.

FIG. 7 shows a structure of an encoding apparatus 110E, which is an example of the encoding apparatus 110 shown in FIG. 1.

The encoding apparatus 110E is identical with the encoding apparatus 110A shown in FIG. 2A except that a sub-band gain encoding section 260E is further included. A band gain encoding section 210E, an encoding band determination section 220E, a spectrum encoding section 230E, and an encoded stream generation section 240E of the encoding apparatus 110E respectively correspond to the band gain encoding section 210A, the encoding band determination section 220A, the spectrum encoding section 230A, and the encoded stream generation section 240A of the encoding apparatus 110A.

A frequency spectrum stream (corresponding to a scale factor band) which is determined by the encoding band determination section 220E not to be quantized or encoded is input to the sub-band gain encoding section 260E. The sub-band gain encoding section 260E selects all or a part of such a frequency spectrum stream(s). Herein, such a selected frequency band is referred to as a "sub-band gain encoding application band".

The sub-band gain encoding application band may be changed in accordance with the amount of information used by the spectrum encoding section 230E for encoding. For example, when the amount of information encoded by the spectrum encoding section 230E is larger than a threshold, the sub-band gain encoding section 260E decreases the sub-band gain encoding application band. By contrast, when the amount of information encoded by the spectrum encoding section 230E is smaller than a threshold, the sub-band gain encoding section 260E increases the sub-band gain encoding application band.

At least one frequency spectrum in the sub-band gain encoding application band is divided into a plurality of sub-bands. Each sub-band may include two or more frequency bands.

In the following example, one sub-band gain encoding application band includes 16 data units in a frequency spectrum. In this example, the frequency spectra are arranged from the frequency spectrum corresponding to the lowest frequency band to the highest frequency band. The frequency spectra corresponding to the three sub-bands are respectively divided into five, six and five data units.

Figure 9:
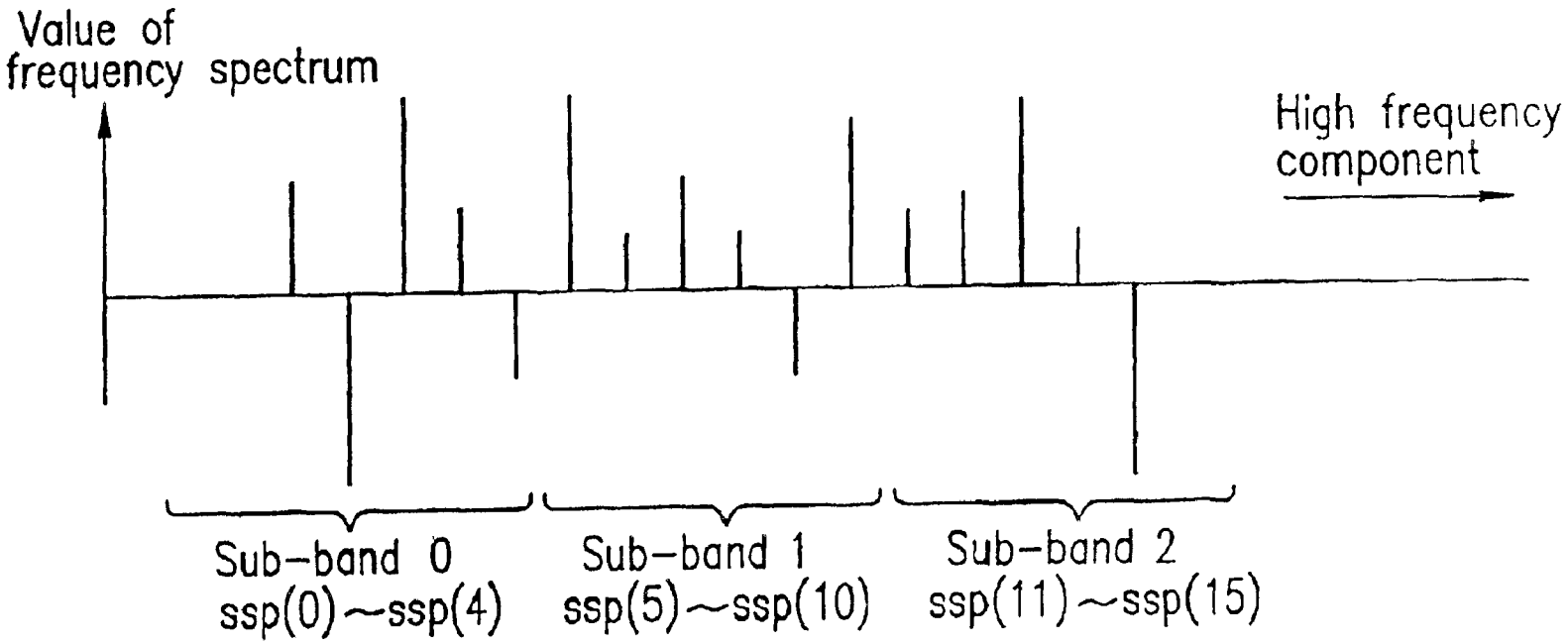
FIG. 9 is a graph schematically illustrating frequency spectra of sub-bands obtained by the encoding apparatus shown in FIG. 7.
Figure 10:
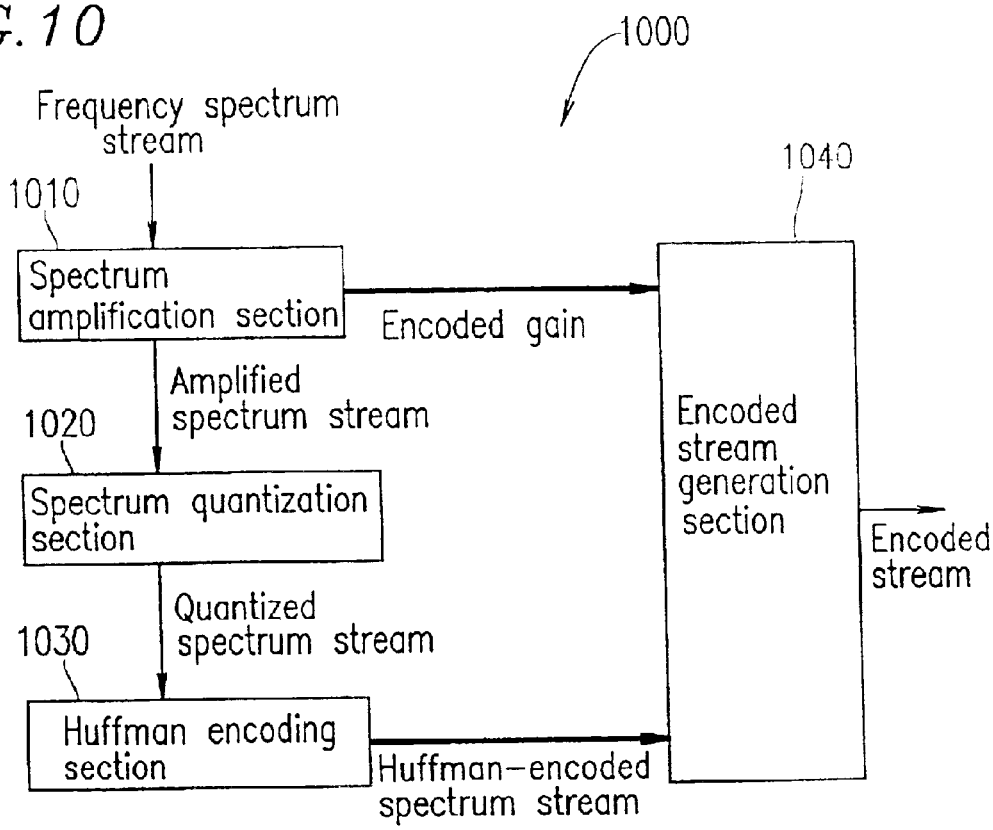
FIG. 10 shows a structure of a conventional encoding apparatus.

FIG. 9 schematically shows frequency spectra in one sub-band in the third example. Sub-band 0 corresponds to the lowest frequency band, sub-band 1 corresponds to the next lowest frequency band, and sub-band 2 corresponds to the highest of the three frequency bands. An average amplitude of each sub-band is calculated using, for example, expression (8).

$$subG[i] = \sqrt{\frac{1}{N(i)} \sum_{j=start(i)}^{end(i)} ssp(j) * ssp(j)} \quad (8)$$

$$\begin{cases} N(0) = 5 \\ N(1) = 6 \\ N(2) = 5 \end{cases} \begin{cases} \text{start}(0) = 0, \text{end}(0) = 4 \\ \text{start}(1) = 5, \text{end}(1) = 10 \\ \text{start}(2) = 11, \text{end}(2) = 15 \end{cases}$$

The sub-band gain encoding application band includes data of three sub-bands, i.e., ssp(j), and subG[i] represents an average amplitude of the calculated sub-band i. The sub-band gain encoding section 260E encodes the average amplitude of each sub-band based on whether the calculated average amplitude is larger than or smaller than a threshold. The result of encoding is sent to the encoded stream generation section 240E. Encoded subGsw[i] representing whether the calculated average amplitude is larger or smaller than the threshold is given by, for example, expression (9).

$$subGsw[i] = \begin{cases} 1 & (subG[i] \geq Th) \\ 0 & (subG[i] < Th) \end{cases} \quad (9)$$

where Th is a threshold for implementation.

Figure 8:
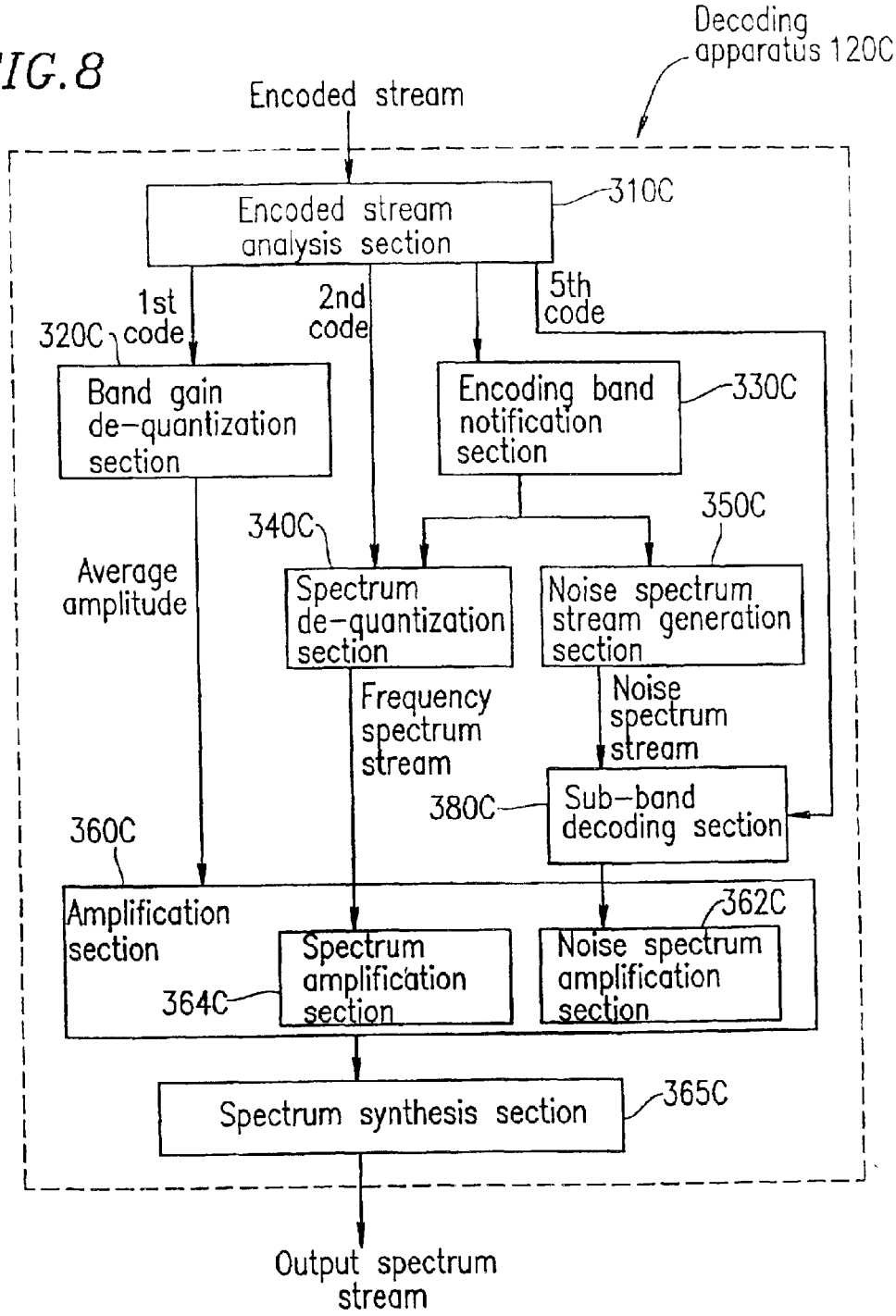
FIG. 8 shows a structure of still another example of the decoding apparatus 120 shown in FIG. 1.

FIG. 8 shows a structure of a decoding apparatus 120C, which is an example of the decoding apparatus 120 shown in FIG. 1.

The decoding apparatus 120C is identical with the decoding apparatus 120A shown in FIG. 3 except that a sub-band gain decoding section 380C is further included. An encoded stream analysis section 310C, a band gain de-quantization section 320C, an encoding band notification section 330C, a spectrum de-quantization section 340C, a noise spectrum stream generation section 350C, and an amplification section 360C of the decoding apparatus 120C respectively correspond to the encoded stream analysis section 310A, the band gain de-quantization section 320A, the encoding band notification section 330A, the spectrum de-quantization section 340A, the noise spectrum stream generation section 350A, and the amplification section 360A of the decoding apparatus 120A (FIG. 3).

The encoded stream analysis section 310C receives an encoded stream including the fifth code representing an average amplitude of a frequency spectrum stream of each sub-band obtained by dividing a frequency spectrum stream which is not quantized or encoded. Then, the encoded stream analysis section 310C analyzes the encoded stream. The sub-band gain decoding section 380C decodes the fifth code obtained by analysis performed by the encoded stream analysis section 310C into an average amplitude of the frequency spectrum of each sub-band, and generates noise spectrum streams corresponding to the plurality of sub-bands based on the decoded average amplitude.

Accordingly, the sub-band gain decoding section 380C finds a sub-band gain encoding application band from among the frequency bands, for which a corresponding frequency spectrum stream is not to be quantized or encoded. Then, the sub-band gain decoding section 380C obtains an average amplitude of the frequency spectrum stream in the sub-band in each sub-band gain encoding application band. The sub-band gain decoding section 380C multiplies the noise spectrum which is output from the noise spectrum stream generation section 350C by the obtained average amplitude, and outputs the multiplication result. The output from the sub-band gain decoding section 380C is obtained by, for example, expression (10).

$$bn(i) = subGsw[j] * nsp(i) \quad (10)$$

$$\begin{cases} j = 0 & (i = 0, 1, 2, 3, 4) \\ j = 1 & (i = 5, 6, 7, 8, 9, 10) \\ j = 2 & (i = 11, 12, 13, 14, 15) \end{cases}$$

where nsp(i) represents a noise spectrum, and bn(i) represents a frequency spectrum which is output from the sub-band gain decoding section 380C. The output from the sub-band gain decoding section 380C is input to the amplification section 360C. The operation performed after this is similar to that described in the first example.

The encoded stream obtained in an encoding apparatus according to the present invention, although having a reduced amount of data, can be decoded into an audio signal including data over a wide frequency range. According to the present invention, detailed waveforms of spectra corresponding to all the frequency bands in a wide range are not encoded, but instead, for some of the frequency bands, only an average amplitude thereof is encoded. Therefore, the obtained encoded stream has a reduced amount of data, but is decoded into an audio signal holding the average amplitude of each frequency band of the input audio signal. Therefore, the decoded audio signal can be reproduced into a clear sound which does not give the listener the impression of the sound being confined, unlike a sound obtained from a signal of a narrow frequency range. Use of the sub-band gain decoding section 380C allows the information to be only increased by a smaller amount than in the first example even in a frequency band, for which a corresponding frequency spectrum stream is not to be quantized or encoded. Thus, a sound which is closer to the original audio signal can be obtained.

As described above, an encoding apparatus according to the present invention provides an encoded stream which can be decoded into a decoded audio signal of a wide frequency range with a low bit rate.

According to the present invention, detailed waveforms of spectra corresponding to lower frequency bands are encoded using a compression technology such as, for example, Huffman encoding. Regarding higher frequency bands, detailed waveforms of spectra are not encoded, but only information on an average amplitude of each frequency spectrum may be encoded. Thus, the amount of information of the higher frequency components which is consumed by encoding can be minimized. Since the higher frequency components can be decoded using a noise spectrum, the reproduced sound covers a wide frequency range.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An encoding apparatus, comprising:

a band gain encoding section for calculating an average amplitude of a frequency spectrum stream corresponding to each of a plurality of frequency bands so as to generate a first code representing the average amplitude of the frequency spectrum stream;

an encoding band determination section for determining at least one frequency band, for which the corresponding frequency spectrum stream is to be quantized and encoded from among the plurality of frequency bands;

a spectrum encoding section for quantizing and encoding the frequency spectrum stream of each of the at least one frequency band determined by the encoding band determination section so as to generate a second code; and an encoded stream generation section for generating an encoded stream based on the first code and the second code.

2. An encoding apparatus according to claim 1, wherein the encoding band determination section determines whether or not the frequency spectrum stream corresponding to each of the plurality of frequency bands is to be quantized and encoded, based on the size of the first code representing the average amplitude of the frequency spectrum stream.

3. An encoding apparatus according to claim 1, wherein:

the encoding band determination section re-determines a frequency band, for which a corresponding frequency spectrum stream is to be quantized and encoded, among the frequency bands which were not determined to be quantized or encoded, the re-determination being performed based on the size of the second code generated by the spectrum encoding section for the at least one frequency band determined to be quantized and encoded, and the spectrum encoding section quantizes and encodes the frequency spectrum stream for the re-determined frequency band so as to generate a second code.

4. An encoding apparatus according to claim 1, wherein the encoded stream generation section generates the encoded stream based on a third code representing the frequency band determined by the encoding band determination section, the first code, and the second code.

5. An encoding apparatus according to claim 1, wherein the spectrum encoding section performs Huffman encoding.

6. An encoding apparatus according to claim 1, wherein the spectrum encoding section performs vector quantization.

7. An encoding apparatus according to claim 1, wherein the spectrum encoding section performs Huffman encoding and vector quantization.

8. An encoding apparatus according to claim 1, further comprising a time region gain encoding section for calculating an average amplitude of a time signal stream, corresponding to each of a plurality of time regions, which is to be transformed into a frequency spectrum stream of each of the plurality of frequency bands, so as to generate a fourth code representing the average amplitude of the time signal stream.

9. An encoding apparatus according to claim 1, further comprising a sub-band gain encoding section for generating a fifth code representing an average amplitude of each of a plurality of sub-bands, which are obtained by dividing at least one frequency band among frequency bands, for which a corresponding frequency spectrum stream is determined not to be quantized or encoded.

10. An encoding apparatus according to claim 9, wherein at least one of the plurality of sub-bands includes two or more frequency spectrum streams.

11. A decoding apparatus for decoding an encoded stream including a first code and at least one second code, the first code being generated so as to represent an average amplitude of a frequency spectrum stream of one of a plurality of frequency bands, and each of the at least one second code is generated by quantizing and encoding the frequency spectrum stream of the one of the frequency bands, the decoding apparatus comprising:

an encoded stream analysis section for analyzing the encoded stream so as to detect the first code and the at least one second code;

a band gain de-quantization section for de-quantizing the first code detected by the encoded stream analysis section into the average amplitude of the frequency spectrum stream;

an encoding band notification section for notifying whether or not the frequency band corresponding to the at least one second code includes a frequency band corresponding to the first code;

a spectrum de-quantization section for de-quantizing and decoding the second code into the frequency spectrum stream based on the notification by the encoding band notification section that the frequency band corresponding to the at least one second code includes a frequency band corresponding to the first code;

a noise spectrum stream generation section for generating a noise spectrum stream based on the notification by the encoding band notification section that the frequency band corresponding to the at least one second code does not include any frequency band corresponding to the first code; and an amplification section for amplifying the frequency spectrum stream or the noise spectrum stream based on the average amplitude.

12. A decoding apparatus according to claim 11, wherein:

the encoded stream further includes a third code representing a frequency band, for which a corresponding frequency spectrum stream has been quantized and encoded, and the encoding band notification section decodes the third code, and notifies whether or not the frequency band corresponding to the at least one second code includes a frequency band corresponding to the first code, based on the decoded third code.

13. A decoding apparatus according to claim 11, wherein the spectrum de-quantization section performs Huffman decoding.

14. A decoding apparatus according to claim 11, wherein the spectrum de-quantization section performs vector de-quantization.

15. A decoding apparatus according to claim 11, wherein the spectrum de-quantization section performs Huffman decoding and vector de-quantization.

16. A decoding apparatus according to claim 11, wherein:

the encoded stream further includes a fourth code representing an average amplitude of a time signal stream of each of a plurality of time regions, which is to be transformed into a frequency spectrum stream of each of the plurality of frequency bands, and the decoding apparatus further comprises a time gain region decoding section for decoding the fourth code into the average amplitude of the time signal stream.

17. A decoding apparatus according to claim 16, wherein:

the noise spectrum stream generation section generates a noise spectrum stream to be converted into a noise signal of each of the plurality of time regions, based on the fourth code decoded by the time gain region decoding section.

18. A decoding apparatus according to claim 11, wherein:

the encoded stream further includes a fifth code representing an average amplitude of each of a plurality of sub-bands which are obtained by dividing at least one frequency band among frequency bands, for which a corresponding frequency spectrum stream is not to be de-quantized, and the decoding apparatus further comprises a sub-band gain decoding section for decoding the fifth code into the average amplitude of the sub-band and generates a noise spectrum stream for each of the plurality of sub-bands based on the decoded average amplitude.

* * * * *